United States Patent [19]

Barker

[11] 4,084,306

[45] Apr. 18, 1978

[54] METHOD AND APPARATUS FOR TRANSPORTING AND WRAPPING PIPE INSULATION

[75] Inventor: Loren B. Barker, Salem, Ill.

[73] Assignee: American Chain & Cable Company, Inc., Bridgeport, Conn.

[21] Appl. No.: 623,368

[22] Filed: Oct. 17, 1975

[51] Int. Cl.[2] ..... B21D 39/02

[52] U.S. Cl. ..... 29/431; 29/455 R; 156/215; 156/492; 156/570; 29/33 E

[58] Field of Search ..... 156/215, 218, 392, 481, 156/492, 539, 571, 570; 29/200 B, 157 R, 428, 431, 455, 33 E, 728; 113/8; 72/383, 384; 61/105, 106

[56] References Cited

U.S. PATENT DOCUMENTS

| | | | |
|---|---|---|---|
| 2,277,519 | 3/1942 | Laxo | 113/8 |
| 3,206,347 | 9/1965 | Holstein | 156/492 |
| 3,816,221 | 6/1974 | Shank, Jr. | 156/492 |
| 3,822,163 | 7/1974 | Bilotti | 156/481 |
| 3,891,493 | 6/1975 | Terry | 156/271 |
| 3,899,913 | 8/1975 | Schlosser | 156/215 |

*Primary Examiner*—Charles E. Van Horn

*Assistant Examiner*—Basil J. Lewris

*Attorney, Agent, or Firm*—Barnes, Kisselle, Raisch & Choate

[57] ABSTRACT

An apparatus for transporting and wrapping pipe insulation comprising a frame and a pair of arms mounted on the frame for swinging movement about a longitudinal axis. A row of longitudinally spaced vacuum pads is suspended and on each arm a pair of transversly spaced rows of longitudinally spaced vacuum pads are suspended on the arms inwardly of the first-mentioned rows on said arms. Vacuum can be selectively supplied to the rows of vacuum pads. Means are provided for swinging the arms toward and away from one another whereby when the arms are extended and the vacuum pads are brought into engagement with a generally flat piece of insulation, the insulation is engaged and may be lifted and transported by manipulating the frame to bring the insulation adjacent a length of pipe and the arms may thereafter be swung inwardly to wrap the insulation about the length of pipe. Provision is made for rotating the insulation relative to the pipe to make the ends of the insulation panel more readily avaiable to form a seam.

11 Claims, 19 Drawing Figures

METHOD AND APPARATUS FOR TRANSPORTING AND WRAPPING PIPE INSULATION

This invention relates to pipe insulation.

BACKGROUND OF THE INVENTION

In the handling and installation of pipe, it has been quite common to provide pipe insulation. However, where the pipe is extremely large, the handling of the insulation requires much manual labor. A typical example is in an environment such as in Alaska. A typical insulating panel may comprise a sheet of thin galvenized steel having circumferentially spaced longitudinally extending pads of insulation thereon wherein the dimensions of the sheet are 40 feet by 25 feet. The sheet is relatively flexible and therefore extremely difficult to handle by hand. It is therefore desirable to provide some means for handling and transporting such a sheet from one place to another. In addition, when the sheet is to be applied to the pipe, substantial hand labor is required to conform the sheet to the pipe and then fasten the free ends of the panel to one another. A further problem arises in that when the panel is placed on the pipe, the free edges will then tend to be at the bottom of the pipe and there may be very little space for access to fasten the ends.

Accordingly among the objects of the invention are to provide a method and apparatus for manipulating and wrapping pipe insulation; which can transport panels or sheets of insulation from a supply to the pipe and thereafter wrap the insulation about the pipes; which apparatus is sufficiently strong and durable to withstand various climatic conditions; which apparatus permits and provides for rotation of the insulation relative to the pipe to provide access to the seam; and which requires a minimum of manual labor.

SUMMARY OF THE INVENTION

In accordance with the invention, the apparatus for transporting and wrapping pipe insulation comprises a frame, a pair of arms, and means for mounting the arms on the frame for swinging movement about a longitudinal axis. A row of longitudinally spaced vacuum pads is provided on each arm and a pair of transversely spaced rows of longitudinally spaced vacuum pads is positioned inwardly of said first-mentioned rows on the arms. Means are provided for selectively supplying vacuum to the rows of vacuum pads. Means are also provided for swinging the arms toward and away from one another so that when the arms are extended and the vacuum pads are brought into engagement with a generally flat piece of insulation, the insulation is engaged and may be lifted and transported by manipulating the frame to bring the insulation adjacent a length of pipe and the arms may thereafter be swung inwardly to wrap the insulation about said length of pipe. In addition, the arms are mounted so they can be manipulated to rotate the insulation relative to the pipe so that the ends of the insulation can be brought into position to provide access for fastening them to one another.

DESCRIPTION

Figure 1:
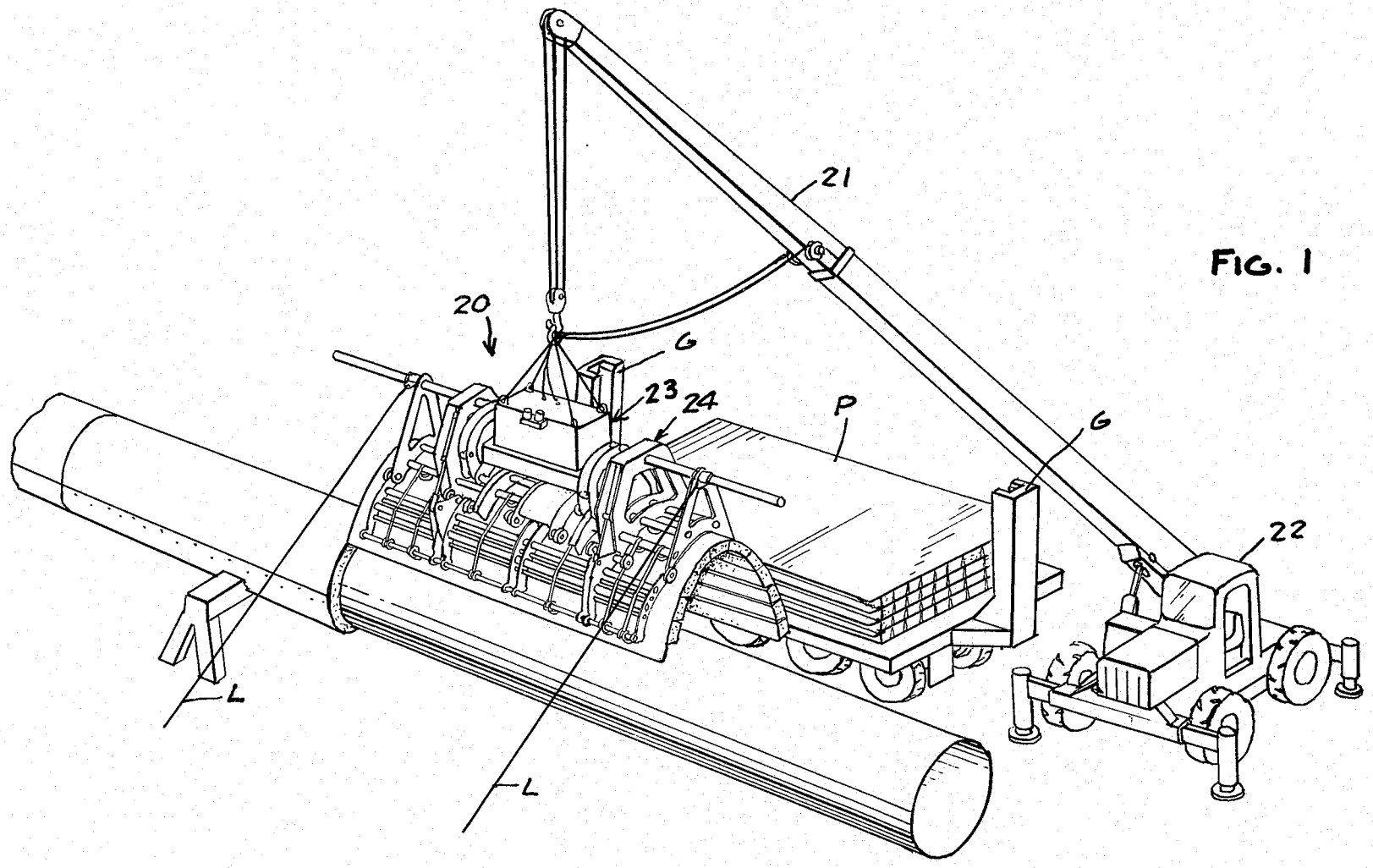
FIG. 1 is a perspective view of an apparatus embodying the invention shown in position on the boom of a crane.

Referring to FIG. 1, the apparatus 20 embodying the invention is adapted to be supported on the boom 21 of a crane 22 or similar device for movement between the supply of pipe insulation and the pipe to be wrapped.

Figure 2:
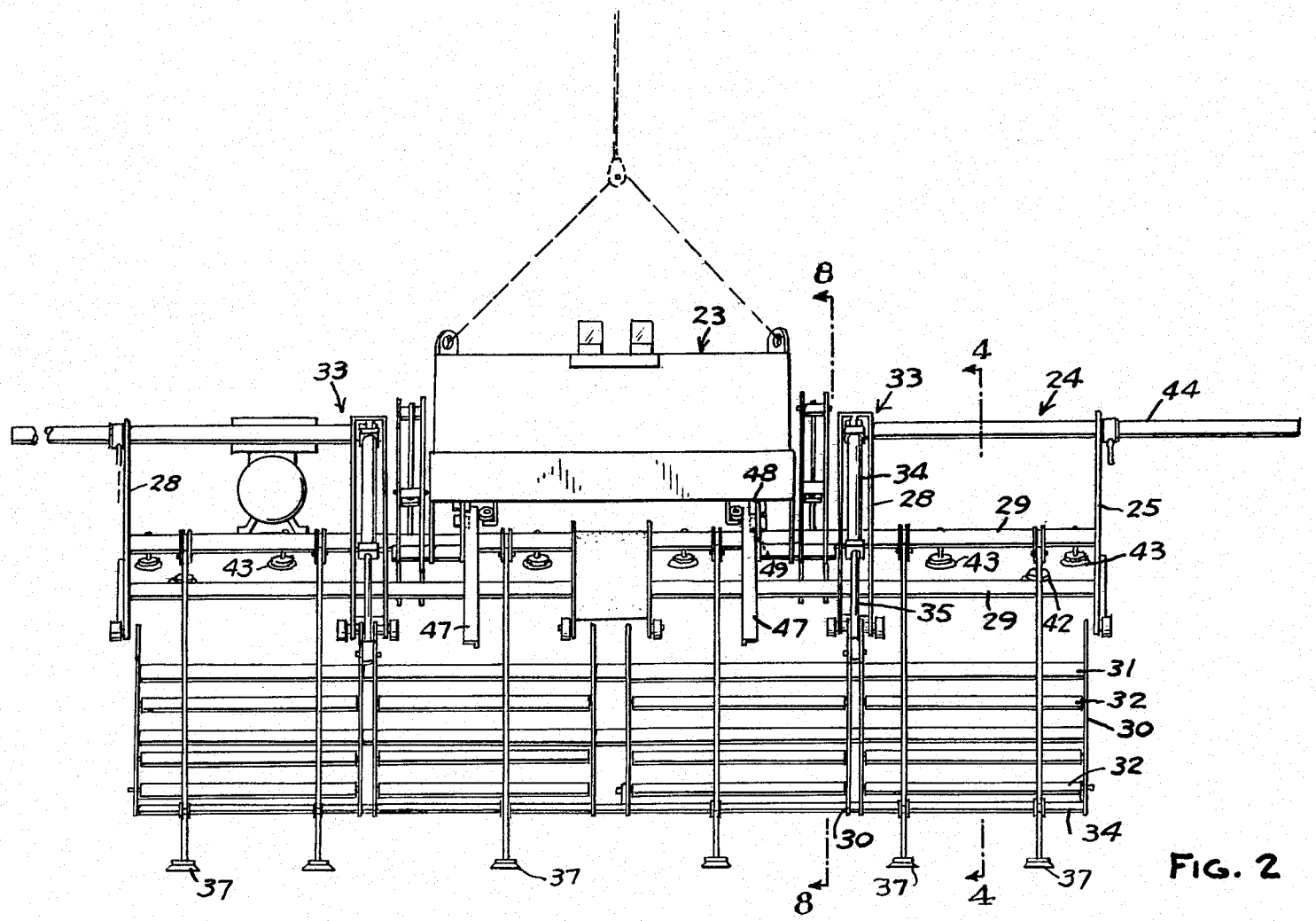
FIG. 2 is a side elevational view of the apparatus.
Figure 3:
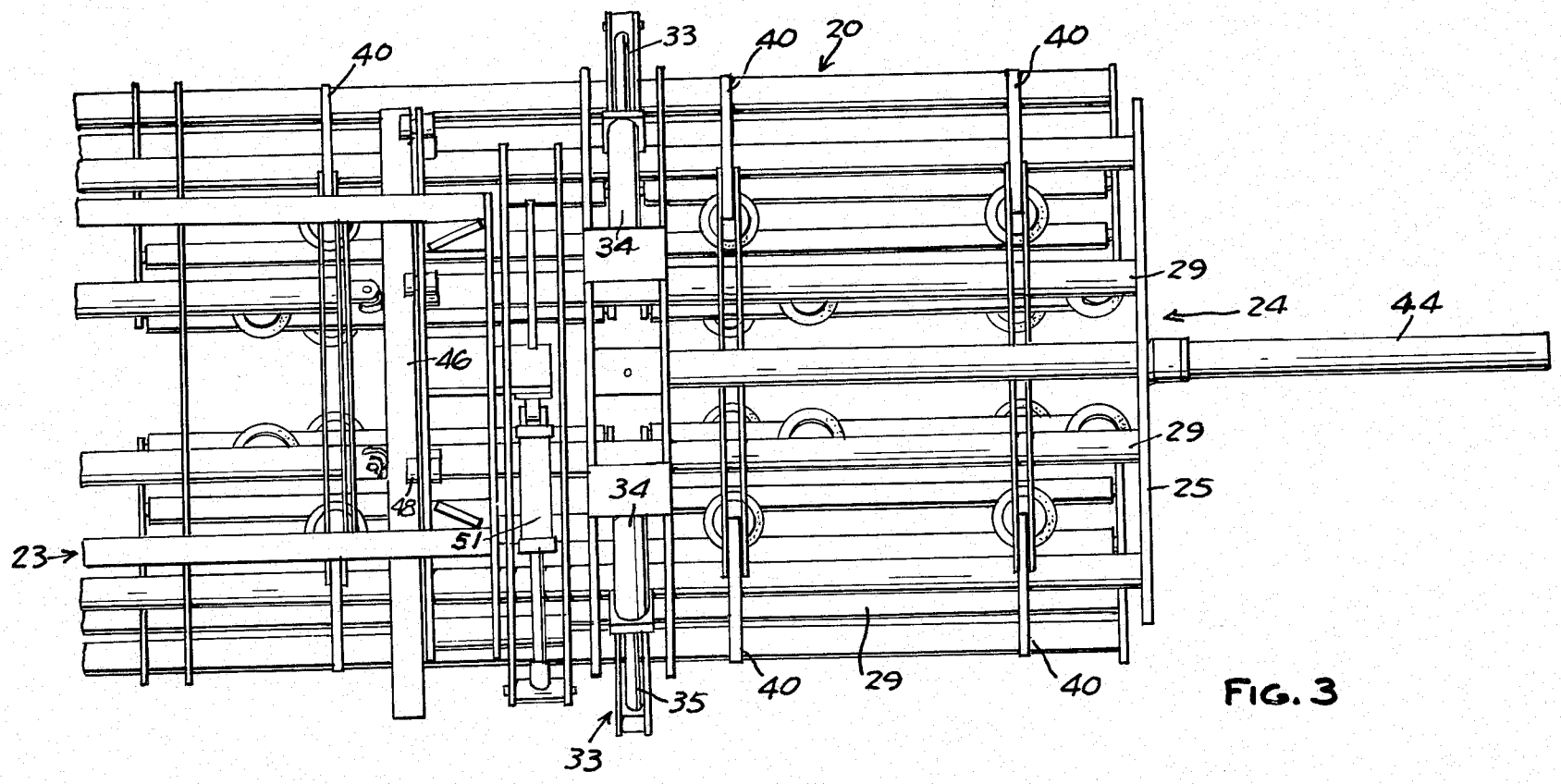
FIG. 3 is a plan view of the apparatus.
Figure 4:
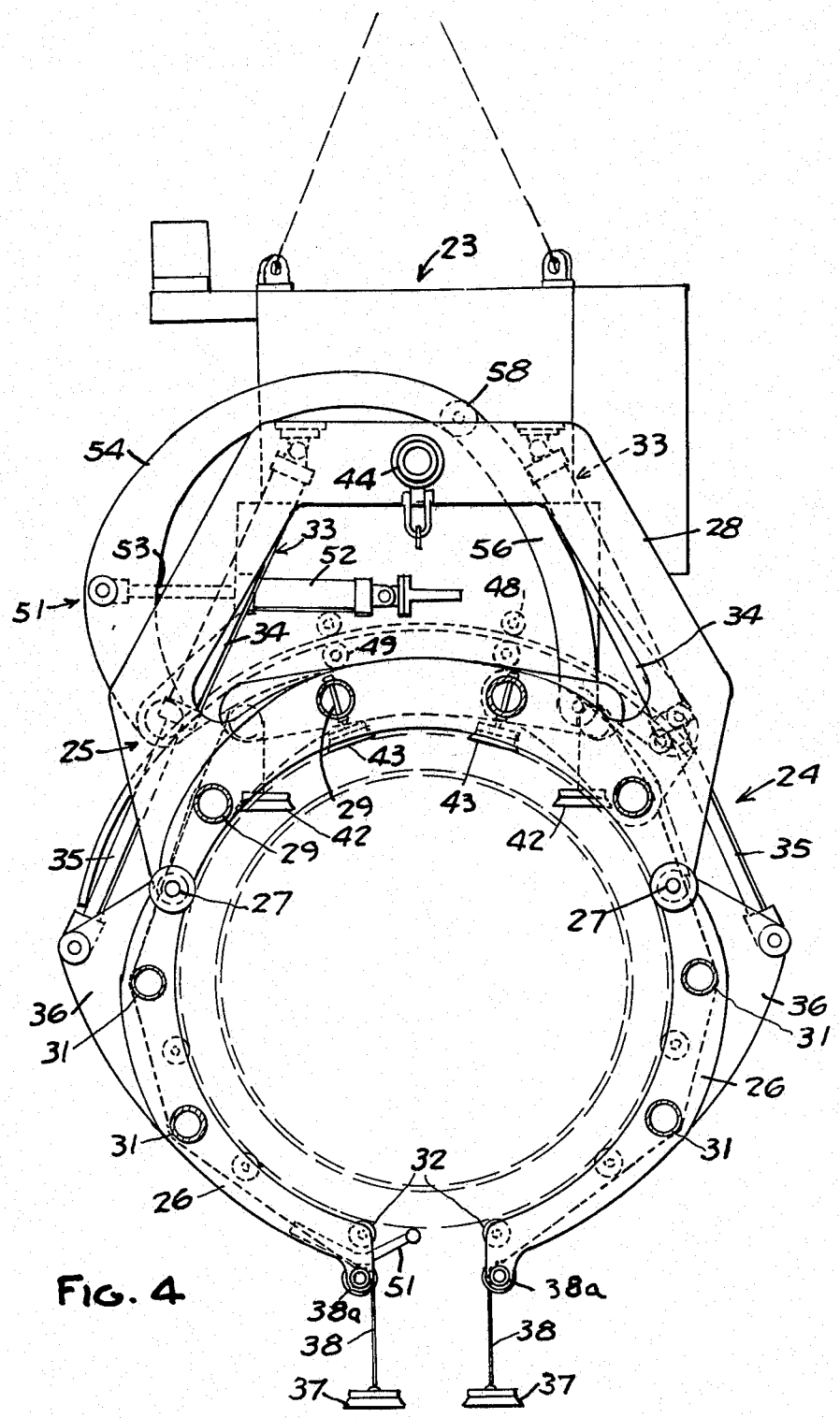
FIG. 4 is a sectional view taken along the line 4—4 in FIG. 2.

Referring to FIGS. 2–4, the apparatus 20 comprises a main frame assembly 23 and a sub frame assembly 24. Main frame assembly 23 comprises a generally rectangular structure which supports the hydraulic and vacuum power units and electrical junction box.

The sub frame assembly 24 is mounted on the main frame assembly 23 as presently described and comprises a central frame 25 and a pair of arms 26 pivoted to the central frame 25 at 27 for swinging movement about longitudinal axes.

As shown, the central frame 25 comprises longitudinally spaced frame members 28 of substantially identical configuration which are interconnected by circumferentially spaced and longitudinally extending tubes 29. Similarly, each arm 26 is made of substantially identical arcuate members 30 interconnected by tubes 31.

Circumferentially spaced longitudinally extending rollers 32 are provided between the members 30 for engaging the insulation as presently described.

Figure 6:
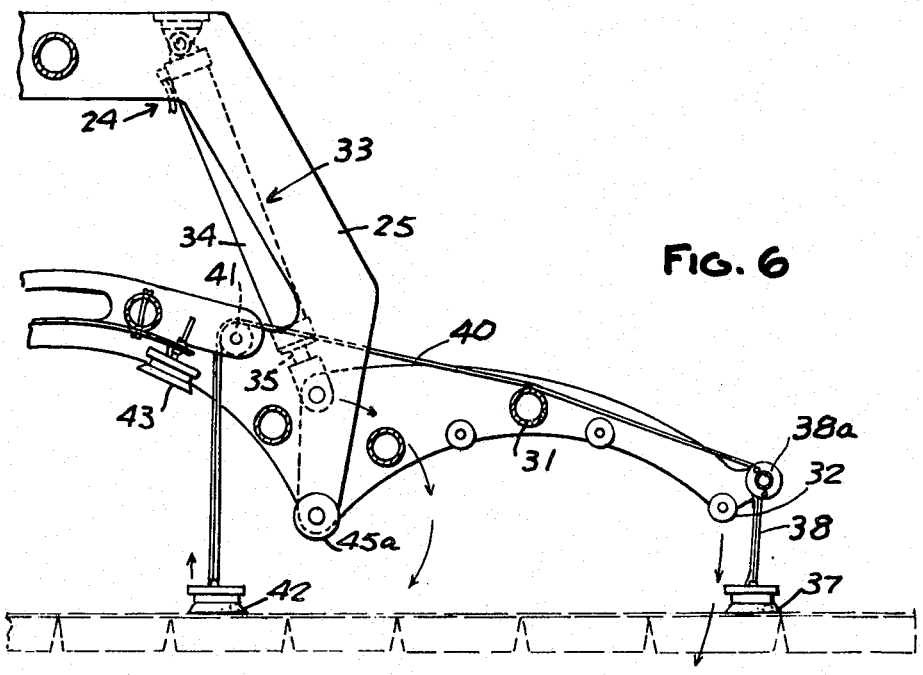
FIG. 6 is a view similar to FIG. 5 showing the parts in their different operative position.
Figure 7:
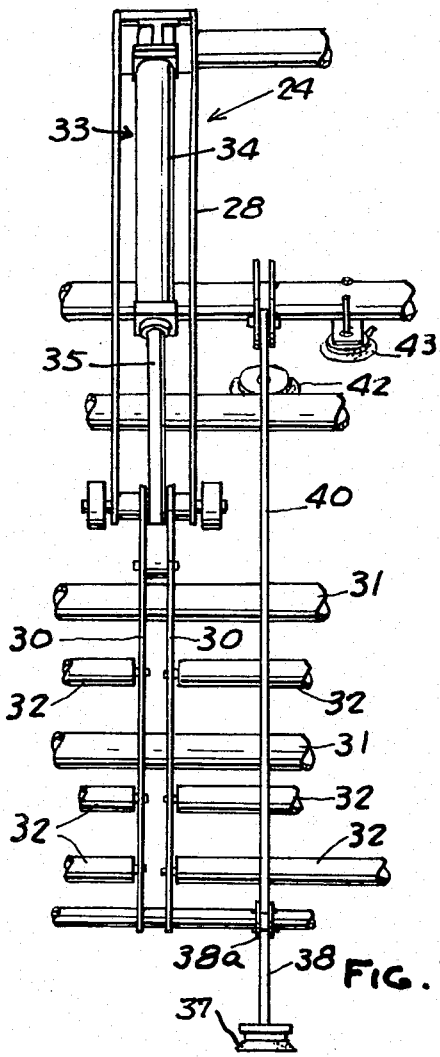
FIG. 7 is a fragmentary side elevational view of the portion of the apparatus shown in FIG. 5.
Figure 5:
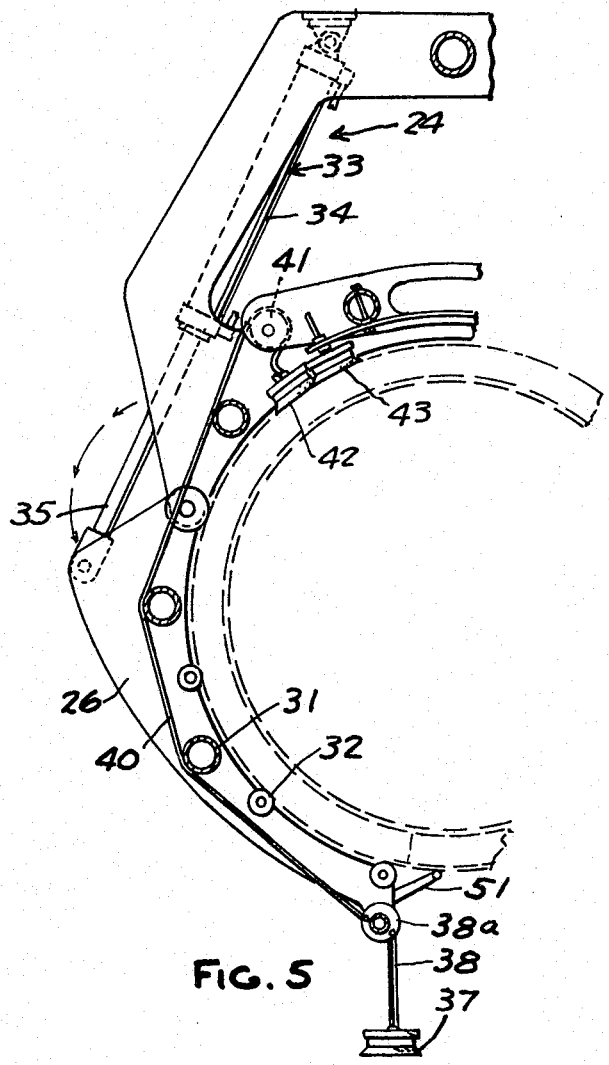
FIG. 5 is a fragmentary enlarged view of a portion of the apparatus shown in FIG. 4.
Figure 8:
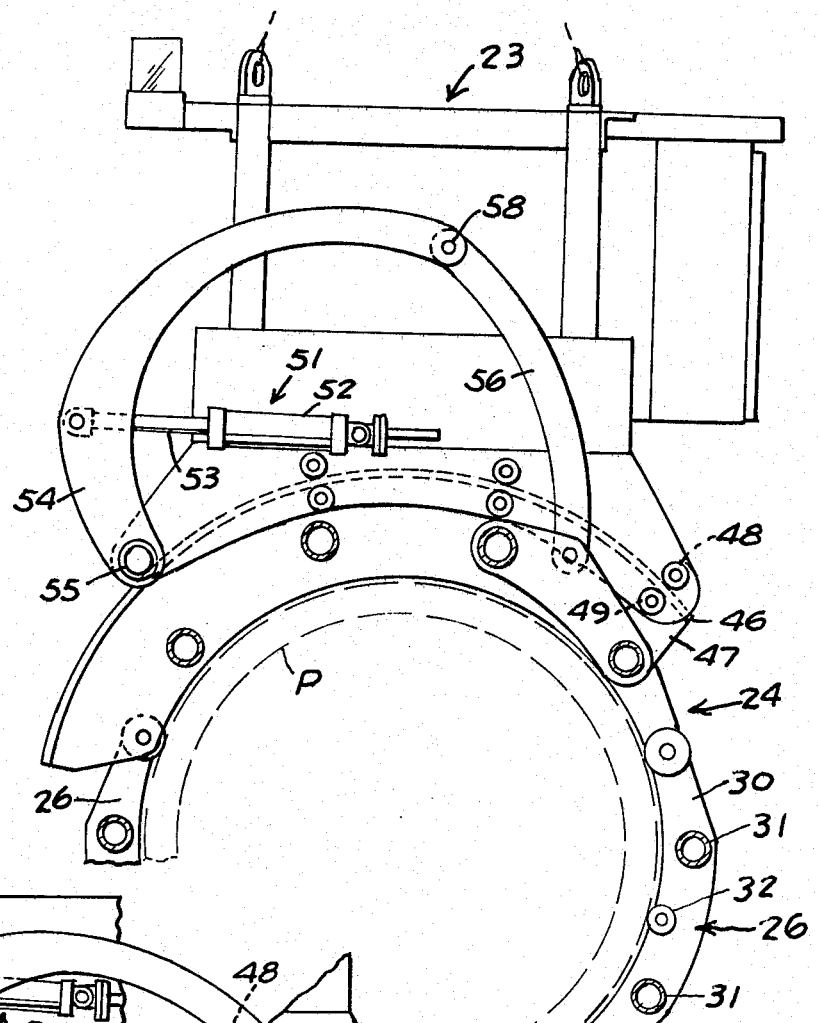
FIG. 8 is a sectional view taken along the line 8—8 in FIG. 2.
Figure 8A:
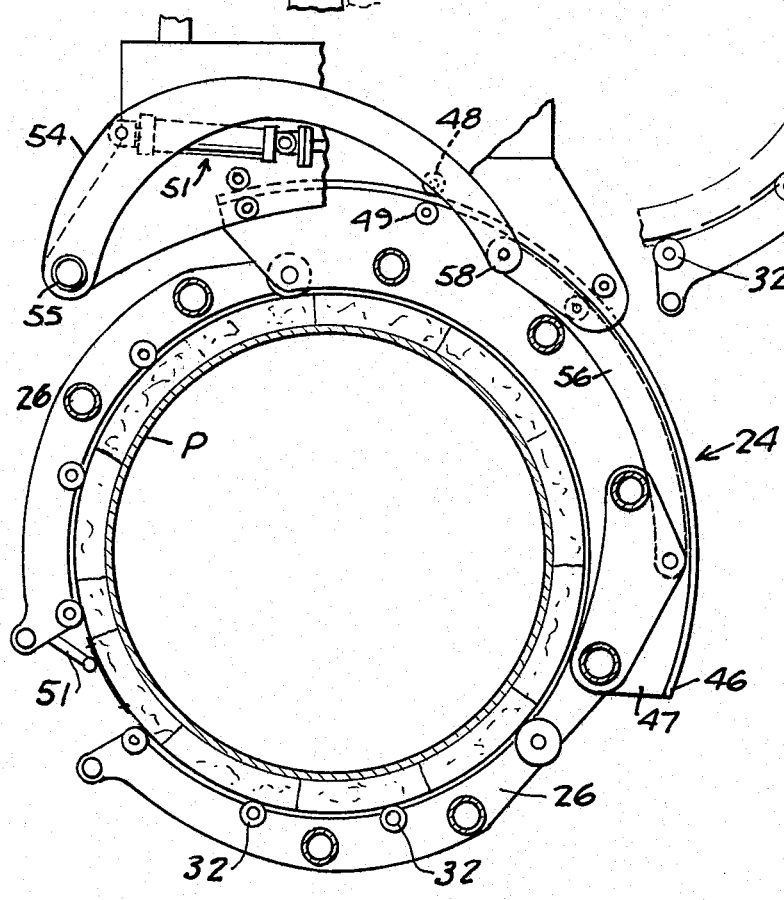
FIG. 8A is a view similar to FIG. 8 showing the parts in a different operative position.
Figure 9:
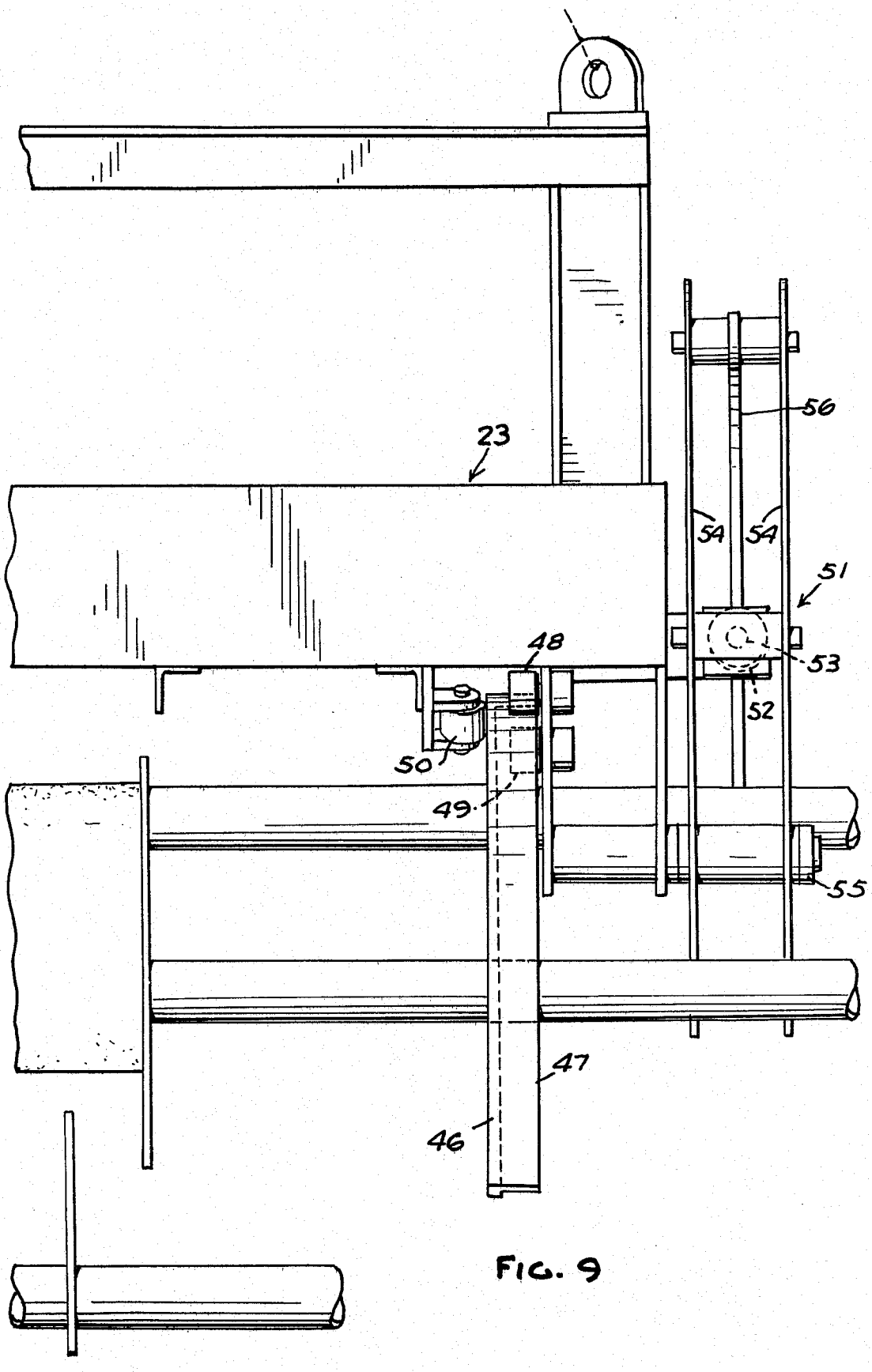
FIG. 9 is a fragmentary side elevational view of the portion of the apparatus shown in FIG. 8.

The arms 26 are moved outwardly and inwardly relative to one another by hydraulic motors 33 which have the cylinder 34 thereof pivoted to the frame 25 and the pistons 35 thereof pivoted to bracket portions 36. Each arm 26 has a row of longitudinally spaced vacuum pads 37 suspended from the end thereof by a strap 38 extending from a pulley **38*a* rotatably mounted on a shaft 39. A flexible strap 40 is also fastened to each pulley 38*a* and extends about the tubes 31 over a pulley 41 rotatably mounted on the frame 25 and a vacuum pad 42 is suspended from the end thereof. By this arrangement as the arms 26 are swung outwardly to the position shown in FIG. 6, each pad 42 is permitted to move downwardly and as the arms 26 are swung inwardly each pad 42 is moved upwardly to the position shown in FIG. 5**.

The sub frame assembly 24 also includes two pairs of rows of longitudinally spaced vacuum pads 43 supported on main frame 25 so that their contacting surfaces are along an arc which is defined by a circle when the arms 26 are moved inwardly toward one another. The sub frame assembly 24 also includes pipes 44 extending longitudinally thereof with free ends 45 extending beyond the arms to serve as guides during the pickup of the insulation, as presently described.

At the pivot 27 of each arm 26, the rollers **45*a*** are provided for engaging the insulation during the wrapping.

To rotate the insulation in order to provide access to the free ends for fastening and forming the seam, the sub frame assembly 24 is rotatable with respect to the main frame 23 about the axis which is defined by the arms when they are moved inwardly. Such an arrangement is obtained by an arcuate angle member 46 which is mounted on the sub frame assembly and has a horizontal flange 47 which is engaged by rollers 48, 49 on the main frame assembly 23. In addition, rollers 50 on the main frame assembly 23 prevent longitudinal movement of the sub frame assembly 24 relative to the main frame assembly 23. The power for rotating the sub frame assembly 24 relative to the main frame assembly 23 is provided by hydraulic motor 51 which has its cylinder 52 pivoted to the main frame assembly 23 and its rod 53 pivoted to a link 54. The link 54 is in turn pivoted at 55 to the sub frame assembly. A second link 56 is pivoted at 57 to the sub frame assembly and the other ends of the links 54, 56 are pivoted to one another as at 58.

In operation, the operator of the crane manipulates cylinders 33 to bring the arms 26 to full open position. The crane is then operated to bring the manipulator over the supply of insulating panels. The crane is then operated to lower the apparatus downwardly to pick up a panel. During this movement the ends 45 of guide tubes 44 engage vertical guides G adjacent the supply to guide the manipulator downwardly into position for picking up the insulation panel. Guy-lines L may be used with the apparatus to guide the apparatus toward the guides G.

As the apparatus is moved downwardly the vacuum pads 37, 42 engage the insulation panel P. The crane is then operated to lift the apparatus and turn the insulation panel and swing it toward the pipeline.

During the movement of the insulation panel toward the pipeline, the operator preferably actuates cylinders 33 to begin moving the arms 26 inwardly until the insulation panel P is formed to a U shape. As the panel P is brought to the pipeline, the apparatus is manipulated so that it is in longitudinal alignment with the pipeline by utilization of guy-lines. The formed U-shaped panel is then lowered over the pipe until the panel rests on top of the pipe. This movement is continued until the vacuum pads 43 engage the insulation panel and then vacuum is applied to the vacuum pads 43.

When the center vacuum pads 43 engage with the insulation, the vacuum to the vacuum pads 37 is released. The apparatus is then raised to free the insulation from the pipe sufficiently to permit rotation of the insulation relative to the pipe. Hydraulic motors 51 are then actuated to rotate the sub frame assembly 24 relative to the main frame assembly 23. Once the rotation is completed, the apparatus is lowered until the insulation rests on the top of the pipe.

Wrapping is then continued by further actuation of hydraulic motors 33. The final wrapping is achieved by first actuating one of the arms 26 completely and then the other arm bringing tucking fingers 51 over the edge to form an overlapping joint. Since the joint is exposed and not at the bottom of the pipeline, a worker may complete the joint by rivets or the like.

In order to remove the apparatus from the wrapped panel, hydraulic motors 33 are actuated to form a wide U shape and clear the wrapped insulation panel. The apparatus is then raised and the guy-lines guide the apparatus during raising thereof. The apparatus is then ready for handling and wrapping of another panel.

I claim:

1. A method of using an apparatus for transporting and wrapping pipe insulation comprising a frame, a pair of arms, means for mounting said arms on said frame for swinging movement about a longitudinal axis, a row of longitudinally spaced vacuum pads on each arm, a pair of transversely spaced rows of longitudinally spaced vacuum pads positioned inwardly of said first-mentioned rows on said arms, a second pair of vacuum pads fixedly mounted on said frame for engagement with the insulation of the pipe, means for selectively supplying vacuum to each said row of vacuum pads, and means for swinging said arms toward and away from one another, a member extending circumferentially and radially inwardly on the end of one said arm and functioning to tuck the one edge of the insulation onto the other edge of the insulation, said one of each said vacuum pads on said arm being interconnected with one of said pair of vacuum pads by a flexible member, said flexible member passing over pulleys rotatably mounted on said frame such that as the arms are moved toward one another, said vacuum pads of said pair of rows are moved upwardly and when said arms are extended, said vacuum pads of said pair of rows move downwardly under the action of gravity, which method comprises extending said arms, bringing said arms adjacent a panel to engage said panel with said vacuum pads on said arms, lifting and transporting said frame to lift and transport said panel toward a pipeline, swinging said arms toward one another to form said panel into a U shape, lowering said frame to move said panel over said pipe, continuing said lowering of said frame until said panel engages said pipe and said second pair of vacuum pads engage said panel, releasing the vacuum on the outer rows of said vacuum pads on said arms, and moving said arms toward one another to completely wrap said panel about said pipe.

2. The method set forth in claim 1 wherein said apparatus includes a subframe for supporting said arms for rotation about the axis of said pipeline which method comprises rotating said subframe to rotate said arms about said axis prior to said step of moving said arms completely toward one another to completely wrap said panel about said pipe.

3. An apparatus for transporting and wrapping pipe insulation comprising a frame, a pair of arms, means for mounting said arms on said frame for swinging movement about a longitudinal axis, a row of longitudinally spaced vacuum pads on each arm, a pair of transversely spaced rows of longitudinally spaced vacuum pads positioned inwardly of said first-mentioned rows on said arms, means for selectively supplying vacuum to each said row of vacuum pads, and means for swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe and said arms may thereafter be swung inwardly to wrap the insulation about said length of pipe, a member extending circumferentially and radially inwardly on the end of one said arm and functioning to tuck the one edge of the insulation onto the other edge of the insulation, said one of each said vacuum pads on said arm being interconnected with one of said pair of vacuum pads by a flexible member, said flexible member passing over pulleys rotatably mounted on said frame such that as the arms are moved toward one another, said vacuum pads of said pair of rows are moved upwardly and when said arms are extended, said vacuum pads of said pair of rows move downwardly under the action of gravity.

4. An apparatus for transporting and wrapping pipe insulation comprising a frame, a pair of arms, means for mounting said arms on said frame for swinging movement about a longitudinal axis, a first row of longitudinally spaced vacuum pads on each arm, a pair of transversely spaced rows of longitudinally spaced vacuum pads positioned inwardly of said first-mentioned rows on said arms, flexible elements for attaching said vacuum pads on said arms and said frame, additional vacuum pads on said frame, means for selectively supplying vacuum to said vacuum pads, and means for selectively swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe and said arms may thereafter be swung inwardly to wrap the insulation about said length of pipe, said flexible elements interconnecting said one of each said vacuum pads on said arm with one of said pair of vacuum pads, said flexible elements passing over pulleys rotatably mounted on said frame such that as the arms are moved toward one another, said vacuum pads of said pair of rows are moved upwardly, and when said arms are extended, said vacuum pads of said pair of rows move downwardly under the action of gravity.

5. The combination set forth in claim 4 wherein said means for swinging arms comprises a hydraulic motor individual to each said arm mounted on said first-mentioned frame and operatively connected to said arms.

6. An apparatus for transporting and wrapping pipe insulation comprising a frame, a pair of arms, means for mounting said arms on said frame for swinging movement about a longitudinal axis, a row of longitudinally spaced vacuum pads on each arm, a pair of transversely spaced rows of longitudinally spaced vacuum pads positioned inwardly of said first-mentioned rows on said arms, means for selectively supplying vacuum to each said row of vacuum pads, and means for swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe and said arms may thereafter be swung inwardly to wrap the insulation about said length of pipe, a main frame, and means for supporting said first-mentioned frame on said frame for rotation about an axis generally coincident with the circle defined by the arms when they are moved toward one another so that the insulation may be rotated relative to the pipe to make the free edges of the insulation more readily accessible for fastening to one another, said last-mentioned means comprising an arcuate member on said first-mentioned frame and rollers on said main frame for supporting said first-mentioned frame from said main frame.

7. An apparatus for transporting and wrapping pipe insulation comprising a main frame, a subframe, a pair of arms, means for mounting said arms on said subframe for swinging movement about a longitudinal axis, a row of longitudinally spaced vacuum pads suspended on each arm, a pair of transversely spaced rows of longitudinally spaced vacuum pads suspended on said subframe inwardly of said first-mentioned rows on said arms, a second pair of vacuum pads fixedly mounted on said subframe for engagement with the insulation on the pipe, means for selectively supplying vacuum to each said row of vacuum pads, means for supporting said subframe on said main frame for rotation about an axis generally coincident with the circle defined by the arms so that the insulation may be rotated about the pipe to make the free edges of the insulation more readily accesible for fastening to one another, means on said main frame and operatively connected to said subframe for rotating said subframe relative to said main frame, and means for swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe, engage at least some of said vacuum pads, rotate the insulation panel about said pipe, and said arms may thereafter be swung inwardly to wrap the insulation about said length of pipe.

8. An apparatus for transporting and wrapping pipe insulation comprising a first frame, a pair of arms, means for mounting said arms on said frame for swinging movement about a longitudinal axis, a row of longitudinally spaced vacuum pads suspended on each arm, a pair of transversely spaced rows of longitudinally spaced vacuum pads suspended on said frame inwardly of said first-mentioned rows on said arms, a second pair of vacuum pads fixedly mounted on said frame for engagement with the insulation on the pipe, means for selectively supplying vacuum to each said row of vacuum pads, a main frame, means for supporting said first-mentioned frame on said main frame for rotation about an axis generally coincident with the circle defined by the arms so that the insulation may be rotated relative to the pipe to make the free edges of the insulation more readily accessible for fastening to one another, and means for swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe, engage said second pair of rows of vacuum pads, rotate the insulation panel relative to said pipe, and said arms may thereafter be swung inwardly to wrap the insulation about said length of pipe, said means for supporting said first-mentioned frame on said second frame comprising an arcuate member on said first-mentioned frame and rollers on said main frame for supporting said first-mentioned frame from said main frame.

9. The combination set forth in claim 8 wherein said means for rotating said first-mentioned frame relative to said main frame comprises a hydraulic motor on said main frame and operatively connected to said first-mentioned frame.

10. The combination set forth in claim 9 wherein said last-mentioned means comprises a pair of links pivoted at one end to one another and their opposite ends to said first-mentioned frame, said hydraulic motor being operatively connected to one of said links.

11. An apparatus for transporting and wrapping pipe insulation comprising a first frame, a pair of arms, means for mounting said arms on said frame for swinging movement about a longitudinal axis, a row of longitudinally spaced vacuum pads suspended on each arm, a pair of transversely spaced rows of longitudinally spaced vacuum pads suspended on said frame inwardly of said first-mentioned rows on said arms, a second pair of vacuum pads fixedly mounted on said frame for engagement with the insulation on the pipe, means for selectively supplying vacuum to each said row of vacuum pads, a main frame, means for supporting said first-mentioned frame on said main frame for rotation about an axis generally coincident with the circle defined by the arms so that the insulation may be rotated relative to the pipe to make the free edges of the insulation more readily accessible for fastening to one another, and means for swinging said arms toward and away from one another whereby when said arms are extended and the vacuum pads are brought into engagement with a generally flat piece of insulation, said insulation is engaged and may be lifted and transported by manipulating the frame to bring the insulation adjacent a length of pipe, engage said second pair of rows of vacuum pads, rotate the insulation panel relative to said pipe, and said arms may thereafter be swung inwardly to wrap the insulation about said length of pipe, one of each said vacuum pads on said arm being interconnected with one of said first-mentioned pair of vacuum pads by a flexible member, said member passing over pulleys rotatably mounted on said frame such that as the arms are moved toward one another, said vacuum pads of said pair of rows are moved upwardly, and when said arms are extended, said vacuum pads move downwardly under the action of gravity.

* * * * *